US007495533B2

(12) United States Patent
Fukunaga

(10) Patent No.: US 7,495,533 B2
(45) Date of Patent: Feb. 24, 2009

(54) WAVEGUIDE OF RECTANGULAR WAVEGUIDE TUBE TYPE HAVING SUB GROUND ELECTRODES

(75) Inventor: Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 259 days.

(21) Appl. No.: 10/588,161

(22) PCT Filed: Jan. 25, 2005

(86) PCT No.: PCT/JP2005/000898

§ 371 (c)(1),
(2), (4) Date: Aug. 1, 2006

(87) PCT Pub. No.: WO2005/072069

PCT Pub. Date: Aug. 11, 2005

(65) Prior Publication Data

US 2007/0159277 A1 Jul. 12, 2007

(30) Foreign Application Priority Data

Feb. 2, 2004 (JP) ..... 2004-024941

(51) Int. Cl.
*H01P 3/18* (2006.01)

(52) U.S. Cl. ..... 333/239; 333/251

(58) Field of Classification Search ..... 333/239, 333/251

See application file for complete search history.

(56) References Cited

U.S. PATENT DOCUMENTS 3,732,511 A * 5/1973 Den ..... 333/242
5,982,256 A * 11/1999 Uchimura et al. ..... 333/239
5,986,527 A * 11/1999 Ishikawa et al. ..... 333/239

FOREIGN PATENT DOCUMENTS

| | | |
|---|---|---|
| JP | A 6-53711 | 2/1994 |
| JP | A 7-202507 | 8/1995 |
| JP | 10-075108 | 3/1998 |
| JP | A 10-303609 | 11/1998 |
| JP | A 11-284409 | 10/1999 |
| JP | A 2001-196502 | 7/2001 |
| JP | A 2003-504924 | 2/2003 |
| WO | WO 01/04986 A1 | 1/2001 |

OTHER PUBLICATIONS

Kunihiro Suetaka, "Microwave Cirecuit", Ohmasha Ltd., Oct. 31, 1985, pp. 148-154 (with Translation).

* cited by examiner

*Primary Examiner*—Benny Lee
(74) *Attorney, Agent, or Firm*—Oliff & Berridge, PLC

(57) ABSTRACT

The present invention provides a waveguide for the TM mode having a simpler configuration. The waveguide has: a pair of main ground electrodes (2*a*) and (2*b*) disposed so as to face each other in parallel with each other with a dielectric block (4) in between; and a pair of side walls (3*a*) and (3*b*), each constructed of a plurality of sub ground electrodes (11) provided between the pair of main ground electrodes (2*a*) and (2*b*), the sub ground electrodes (11) stacked in parallel with the main ground electrodes (2*a*) and (2*b*) with a interval along a direction orthogonal to the main ground electrodes (2*a*) and (2*b*). Electromagnetic waves in the TM mode may propagate in a region (5) surrounded by the pair of main ground electrodes (2*a*) and (2*b*) and the pair of side walls (3*a*) and (3*b*).

4 Claims, 1 Drawing Sheet

WAVEGUIDE OF RECTANGULAR WAVEGUIDE TUBE TYPE HAVING SUB GROUND ELECTRODES

TECHNICAL FIELD

The present invention relates to a waveguide of rectangular waveguide tube type for propagating electromagnetic waves in the TM mode of electromagnetic waves (high frequency signals) such as microwaves and millimeter waves.

BACKGROUND ART

As a waveguide for transmitting electromagnetic waves (high frequency signals) such as microwaves and millimeter waves, a waveguide disclosed in Japanese Patent Laid-Open No. Hei 11-284409 is known. The waveguide has: a pair of main conductor layers sandwiching a dielectric substrate; a group of through conductors for a pair of side walls formed so as to electrically connect the pair of main conductor layers; and a sub conductor layer electrically connected to the group of through conductors for side walls and formed between the pair of main conductor layers in parallel with the main conductor layers. It is considered that the waveguide is directed to electromagnetic waves in the TE mode on the basis of the description in the publication that "parts corresponding to an H plane and an E plane of a dielectric waveguide are formed by a main conductor layer and a group of through conductors for side walls" and "parts corresponding to an E plane and an H plane of a dielectric waveguide are formed by a main conductor layer and a group of through conductors for side walls".

The inventors of the present invention are studying waveguides for electromagnetic waves in the TM mode. A waveguide for the TM mode can be formed by using the configuration disclosed in the publication. In the waveguide of the related art, however, a group of through conductors for side walls made of a number of through conductors for side walls have to be formed in a dielectric, so that the structure is complicated. There is consequently a problem that manufacturing cost is high.

SUMMARY OF THE INVENTION

The present invention has been achieved in consideration of such problems, and a main object of the invention is to provide a waveguide for the TM mode having a simpler configuration.

A rectangular waveguide according to the present invention includes: a pair of main ground electrodes disposed so as to face each other in parallel with each other with a dielectric in between; and a pair of side walls, each side wall constructed of a plurality of sub ground electrodes provided between the pair of main ground electrodes, the sub ground electrode stacked in parallel with the main ground electrodes with a interval along a direction orthogonal to the main ground electrodes. Electromagnetic waves in the TM mode propagate in a region surrounded by the pair of main ground electrodes and the pair of side walls.

Preferably, the width of each of the sub ground electrodes is specified as width L or longer. When the interval is "a", frequency of the electromagnetic wave is "f", dielectric constant of the dielectric is er, light velocity is "c", and natural logarithm is "e", the interval "a" and the width L satisfy the following equation (1).

$$L\times((\pi/a)^2-(2\times\pi\times f/c)^2\times\in r)^{1/2}\geqq 1/\log_{10}e \quad (1)$$

Preferably, the rectangular waveguide further includes resistor layers formed, in legions apart from an inner end face of each of the sub ground electrodes more than the width L, on both faces of each of the sub ground electrodes, and formed, in a region facing the regions, on each of the main ground electrodes.

Preferably, the rectangular waveguide further includes a wave absorbent layer formed, so as to extend between the main ground electrodes, on the side of outer end faces of the sub ground electrodes.

A rectangular waveguide according to the present invention includes: a pair of main ground electrodes disposed so as to face each other in parallel with each other with a dielectric in between; and a pair of side walls, each side wall constructed of a plurality of sub ground electrodes provided between the pair of main ground electrodes, the sub ground electrodes stacked in parallel with the main ground electrodes with a interval along a direction orthogonal to the main ground electrodes. With the configuration, the side walls of the rectangular waveguide which can block electromagnetic waves only by the plurality of sub ground electrodes can be formed by utilizing the characteristic of the electromagnetic waves in the TM mode in which the magnetic field generates only in the direction orthogonal to the propagation direction. Therefore, the rectangular waveguide does not need the group of through conductors for a pair of side walls formed by electrically connecting the pair of main conductor layers, which are necessary for the conventional rectangular waveguide. Thus, the waveguide for the TM mode can be formed with a simpler configuration. As a result, the waveguide can be manufactured at low cost.

In addition, in the rectangular waveguide according to the present invention, the width of each of the sub ground electrodes is specified as width L or longer. When the interval is "a", frequency of the electromagnetic wave is "f", dielectric constant of the dielectric is ∈r, light velocity is "c", and natural logarithm is "e", the interval "a" and the width L satisfy the above equation (1). In such a manner, the electromagnetic wave in the position apart from only by the width (distance) L from the inner end face of each of the sub ground electrodes can be attenuated by 20 dB or more with reliability. As a result, the electromagnetic wave shielding performance can be increased sufficiently.

Further, in the rectangular waveguide according to the invention, resistor layers are formed, in regions apart from an inner end face of each of the sub ground electrodes more than the width L, on both faces of each of the sub ground electrodes, and formed, in a region facing the regions, on each of the main ground electrodes. Consequently, the electromagnetic wave in the TE mode generated in the rectangular waveguide can be sufficiently attenuated by the resistor layers.

In the rectangular waveguide according to the invention, a wave absorbent layer is formed, so as to extend between the main ground electrodes, on the side of outer end faces of the sub ground electrodes. With the configuration, the shielding performance against the electromagnetic wave in the TM mode and the electromagnetic wave in the TE mode can be further increased.

BEST MODE FOR CARRYING OUT THE INVENTION

A preferable embodiment of a rectangular waveguide according to the present invention will be described hereinbelow with reference to the attached drawings.

First, the configuration of the rectangular waveguide (hereinbelow, also called "waveguide") according to the invention will be described with reference to the drawings.

Figure 1:
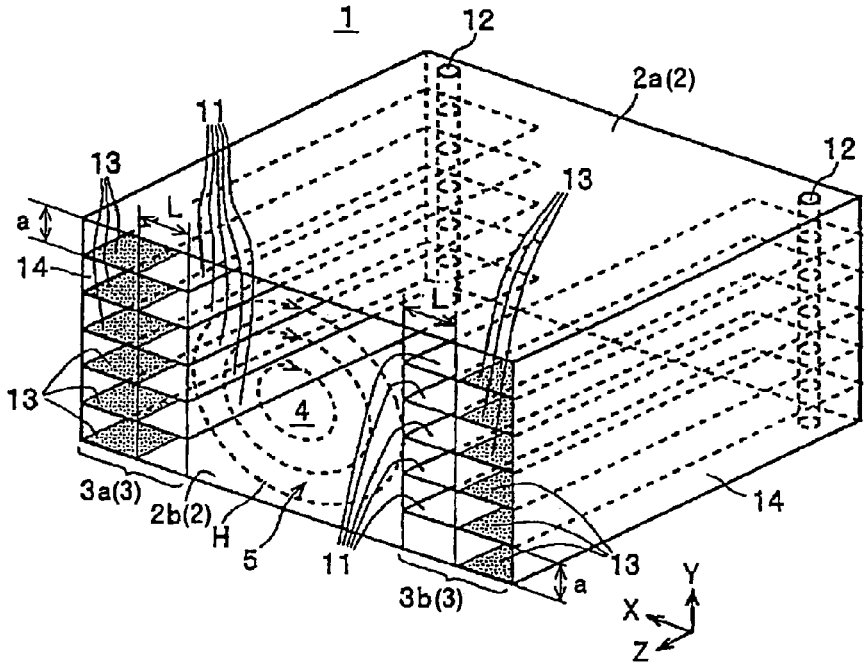
FIG. 1 is a perspective view showing the configuration of a waveguide according to an embodiment of the present invention.
Figure 2:
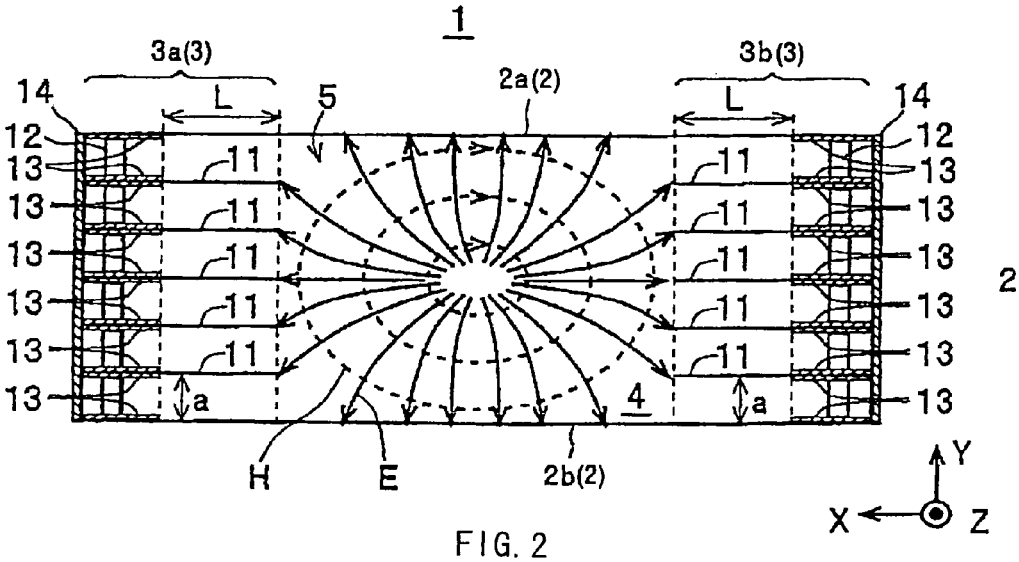
FIG. 2 is a front view when the waveguide of FIG. 1 is viewed from the Z direction.

As shown in FIGS. 1 and 2, a waveguide 1 has a pair of main ground electrodes 2*a* and 2*b* (hereinbelow, also called "main ground electrodes 2" when they are not distinguished from each other), a pair of side walls 3*a* and 3*b* (hereinbelow, also called "side walls 3" when they are not distinguished from each other), and a dielectric block 4. In a region 5 surrounded by the main ground electrodes 2 and the side walls 3 in the dielectric block 4 and formed in a rectangular shape in section, electromagnetic waves in the TM mode can propagate.

Each of the main ground electrodes 2 is formed in a rectangular plate shape as shown in FIGS. 1 and 2. The main ground electrodes 2 are disposed so as to be parallel with each other with the dielectric block (dielectric in the invention) 4 in between and so as to face each other. Each of the side walls 3 is constructed by a plurality of sub ground electrodes 11 disposed so as to have the dielectric block 4 therebetween, in other words, disposed on the lower side of the dielectric block 4 in the diagram and each formed in a rectangular plate shape. More concretely, each of the side walls 3 is constructed by disposing a plurality of (five, as an example, in the diagram) sub ground electrodes 11 in the dielectric block 4 between the pair of main ground electrodes 2*a* and 2*b* with a interval "a" along a direction (Y direction in the diagram) orthogonal to the main ground electrodes 2 and in parallel with the main ground electrodes 2. The sub ground electrodes 11 in each of the side walls 3 are disposed so as to overlap each other when viewed from the Y direction. The pair of side walls 3 is disposed in parallel with each other along the electromagnetic wave propagation direction (Z direction in the diagram). The sub ground electrodes 11 are electrically connected to the main ground electrodes 2 via through conductors 12 disposed so as to extend between the pair of main ground electrodes 2*a* and 2*b* as shown in FIG. 2. The through conductors 12 function not only to confine the electromagnetic waves propagating through the region 5 in the region 5 but also to maintain the sub ground electrodes 11 of the side walls 3 at the same potential (ground potential) as that of the main ground electrodes 2. Therefore, different from the conventional waveguide, it is unnecessary to dispose a number of through conductors 12 in rows at equal intervals along the electromagnetic wave propagation direction. Consequently, it is sufficient to dispose at least one through conductor 12 in each of the side walls 3. From the viewpoint of simplifying the structure of the waveguide 1, it is preferable to dispose a few through conductors 12.

Magnetic fields H of the electromagnetic waves in the TM mode propagating in the Z direction are generated in a plane parallel with an X-Y plane as shown in the diagram. When the magnetic fields H reach the regions in which the side walls 3 are formed, the magnetic fields H cross the sub ground electrodes 11 forming the side walls 3. Therefore, penetration of the magnetic fields H between the sub ground electrodes 11 and between the sub ground electrode 11 and the main ground electrode 2 is regulated by the sub ground electrodes 11. As a result, the side walls 3 function as electric walls for the electromagnetic waves in the TM mode. That is, the side walls 3 have the function of confining the electromagnetic waves in the TM mode in the region 5 in cooperation with the main ground electrodes 2. For easier understanding, in FIGS. 1 and 2, the thickness of the main ground electrodes 2 and the sub ground electrodes 11 is omitted. In FIG. 2, electric fields of the electromagnetic fields in the TM mode are shown by reference character E.

Further, the width (width along the X direction) of each of the sub ground electrodes 11 is specified to width L or longer. When the frequency of the propagating electromagnetic wave is "f", dielectric constant of the dielectric block 4 is $\in r$, light velocity is "c", and natural logarithm is "e", a interval "a" and the width L satisfy the following equation (1). With the configuration, the side walls 3 enhances the shielding performance against the electromagnetic waves in the TM mode by attenuating the electromagnetic waves in the TM mode entered between the sub ground electrodes 11 and between the main ground electrode 2 and the sub ground electrode 11 by 20 dB or more in positions apart from the inner end faces of the sub ground electrodes 11 only by the width (distance) L. The inner end face of the sub ground electrode 11 is the end face facing the region 5, of each sub ground electrode 11.

$$L\times((\pi/a)^2-(2\times\pi\times f/c)^2\times\in r)^{1/2}\geqq 1/\log_{10}e \quad (1)$$

As shown in FIGS. 1 and 2, a resistor layer 13 is formed in each of an outside region apart from the inner end face by more than the width L in both faces of each of the sub ground electrodes 11 and one face of each of the main ground electrodes 2 facing the outside region. In this case, the resistor layer 13 can be formed by, for example, an absorption resistor of a great loss. Further, on the outer end faces of the sub ground electrodes 11, wave absorbent layers 14 are formed on the outside of the side walls 3*a* and 3*b* so as to surround the pair of side walls 3 and the dielectric block 4. In this case, the wave absorbent layers 14 are formed so that their edges in the Y direction are in contact with the edges in the X direction of the main ground electrodes 2*a* and 2*b*. In other words, each of the wave absorbent layers 14 is formed in a state where it is suspended across the main ground electrodes 2*a* and 2*b*. In this case, the wave absorbent layer 14 has the function of absorbing electromagnetic wave energy (electric waves) and is made of, for example, one or more kinds of materials such as a conduction loss material, a magnetic loss material, and a dielectric loss material. As the conduction loss material, for example, carbon is used as a main material. As the magnetic loss material, for example, an oxide magnetic material is used as a main material. Alternatively, a metal magnetic material can be used. Further, as a dielectric loss material, for example, a barium titanatez is used as a main material. The material of the wave absorbent layer 14 is not limited to the above. Not only existing materials but also arbitrary materials to be developed in future can be properly used.

Next, the operation of the waveguide 1 will be described by referring to FIGS. 1 and 2.

In the waveguide 1, propagation in the Y directions of the electromagnetic waves in the TE mode supplied to the region 5 surrounded by the pair of main ground electrodes 2*a* and 2*b* and the pair of side walls 3*a* and 3*b* is regulated by the main ground electrodes 2, and propagation in the X directions is regulated by the side walls 3. Therefore, the electromagnetic waves propagate in the Z direction in the region 5 while being reflected by the main ground electrodes 2 and the side walls 3.

On the other hand, depending on the frequency of the electromagnetic waves supplied to the waveguide 1, the electromagnetic waves in the TE mode may be generated in the region 5. In this case, in the electromagnetic waves in the TE mode, an H plane is formed in a plane (X-Z plane) parallel with the main ground electrodes 2, and magnetic fields are generated in the H plane. Even if the magnetic fields of the electromagnetic waves in the TE mode reach the formation region of each of the side walls 3, they can enter the outside region of each of the sub ground electrodes 11 without crossing each of the sub ground electrodes 11. However, in the waveguide 1, the magnetic field of the electromagnetic wave in the TE mode which enters the outside region is weakened when it passes through the resistor layer 13 formed on the outside regions on both faces of each of the sub ground electrodes 11 and the resistor layer 13 formed on one face of each of the main ground electrodes 2 facing the outside region. Therefore, the electromagnetic waves in the TE mode generated in the region 5 in the waveguide 1 are attenuated by the resistor layers 13. The electromagnetic wave in the TM mode or the electromagnetic wave in the TE mode entering between the sub ground electrodes 11 and between the sub ground electrode 11 and the main ground electrode 2 can reach the outer end face side of each sub ground electrode 11 while being attenuated. At this time, each of the wave absorbent layers 14 absorbs each of the electromagnetic wave in the TM mode and the electromagnetic wave in the TE mode which has reached the outer face end side of each of the sub ground electrodes 11. Therefore, leakage to the outside of the waveguide 1, of the electromagnetic wave in the TM mode and the electromagnetic wave in the TE mode is prevented.

As described above, in the waveguide 1, by forming a pair of side walls 3 by disposing the plurality of sub ground electrodes 11 in parallel with the main ground electrodes 2 at the interval "a" between the main ground electrodes 2*a* and 2*b*, the shielding function of the side walls 3 against the electromagnetic waves can be realized only by the plurality of sub ground electrodes 11 using the characteristics of the electromagnetic waves in the TM mode in which the magnetic field is generated only in the direction orthogonal to the propagation direction (Z direction). Consequently, a group of through conductors for side walls, made of a number of through conductors for side walls needed in the conventional rectangular waveguide can be made unnecessary. As a result, the waveguide for the TM mode can be constructed simply. Therefore, the waveguide 1 can be manufactured at low cost. The sub ground electrodes 11 are formed with the width satisfying the equation (1), and the sub ground electrodes 11 are disposed with the interval "a" satisfying the equation (1), thereby enabling the shielding performance against the electromagnetic wave in the TM mode of the side walls 3 to be further enhanced.

In the waveguide 1, by forming the resistor layer 13 on both of the faces of each of the sub ground electrodes 11 and one face (surface) of each of the main ground electrodes 2, the magnetic field of the electromagnetic waves in the TE mode entering the outside region of each of the sub ground electrodes 11 can be weakened by the resistor layer 13. Consequently, the electromagnetic waves in the TE mode generated in the region 5 in the waveguide 1 can be attenuated sufficiently. Further, by forming the wave absorbent layer 14 on each of the outer end faces of each sub ground electrode 11, the electromagnetic wave in the TM mode and the electromagnetic wave in the TE mode reaching the outer end faces of each sub ground electrode 11 can be absorbed by the wave absorbent layer 14. Therefore, a leakage from the waveguide 1, of the electromagnetic wave in the TM mode and the electromagnetic wave in the TE mode can be prevented more preferably.

The present invention is not limited to the above-described configuration. Although the waveguide 1 employs, as an example, the configuration of electrically connecting the sub ground electrodes 11 and the main ground electrodes 2 by using the through conductors 12, the invention is not limited to the configuration. The invention can also employ, for example, a configuration of electrically connecting the end faces of the sub ground electrodes 11 and the main ground electrodes 2 via a wiring pattern or a connection conductor. With the configuration, it becomes unnecessary to form the through conductors 12 in the dielectric block 4. As a result, the structure can be further simplified. The waveguide 1 can be also formed by using a multilayer substrate. Concretely, in the case of forming the waveguide 1 by a multilayer substrate, a 7-layer substrate is used, the main ground electrodes 2 are formed on both faces (the uppermost face and the lowest face) of the substrate, and the sub ground electrodes 11 constructing the side walls 3 are formed in the layers. As the through conductors 12, a through hole is formed. In such a manner, the waveguide 1 is formed by the multilayer substrate. By using the waveguide 1, a resonator or a filter can be also formed.

What is claimed is:

1. A rectangular waveguide comprising:

a pair of main ground electrodes disposed so as to face each other in parallel with each other with a dielectric in between; and a pair of side walls, each side wall constructed of a plurality of sub ground electrodes provided between the pair of main ground electrodes, the sub ground electrodes stacked in parallel with the main ground electrodes with a interval along a direction orthogonal to the main ground electrodes, wherein electromagnetic waves in the TM mode propagate in a region surrounded by the pair of main ground electrodes and the pair of side walls, when the interval is "a", frequency of the electromagnetic wave is "f", dielectric constant of the dielectric is $\in r$, light velocity is "c", and natural logarithm is "e", the interval "a" and a width L satisfy the following equation (1):

$$L\times((\pi/a)^2-(2\times\pi\times f/c)^2\times\in r)^{1/2}\geqq 1/\log_{10}e \quad (1), \text{ and}$$

the width of each of the sub ground electrodes is equal to or greater than L.

2. The rectangular waveguide according to claim 1, further comprising a wave absorbent layer disposed so as to extend between the pair of main ground electrodes outside of the outer end faces of at least one of the plurality of the sub ground electrodes.

3. The rectangular waveguide according to claim 1, wherein each sub ground electrode includes an inner end face adjacent to the region and an outer end face distal from the region, wherein, for each sub around electrode, a resistor layer is disposed near the outer end face of the sub around electrode and away from the inner end face of the sub ground electrode by at least a length greater than the width L.

4. The rectangular waveguide according to claim 3, further comprising a wave absorbent layer disposed so as to extend between the pair of main ground electrodes, outside of the outer end faces of at least one of the plurality of the sub ground electrodes.

* * * * *